United States Patent [19]

Müller

[11] Patent Number: 4,811,641

[45] Date of Patent: Mar. 14, 1989

[54] APPARATUS FOR CUTTING AND DIVIDING A CONTINUOUS STREAM OF PRINTED PRODUCTS

[75] Inventor: Hans Müller, Leimen, Fed. Rep. of Germany

[73] Assignee: Heidelberger Druckmaschinen Aktiengesellschaft, Heidelberg, Fed. Rep. of Germany

[21] Appl. No.: 114,416

[22] Filed: Oct. 28, 1987

[30] Foreign Application Priority Data

Oct. 31, 1986 [DE] Fed. Rep. of Germany ..... 3637110

[51] Int. Cl.[4] ..... B26D 7/06

[52] U.S. Cl. ..... 83/105; 83/154; 83/161; 83/343; 83/346; 83/347

[58] Field of Search ..... 83/105, 154, 161, 343, 83/346, 347

[56] References Cited

U.S. PATENT DOCUMENTS

| | | | |
|---|---|---|---|
| 3,088,359 | 5/1963 | Schur | 83/105 |
| 3,240,089 | 3/1966 | Chamberlain et al. | 83/105 |
| 3,516,315 | 6/1970 | Suzuki | 83/105 |
| 4,176,535 | 12/1979 | Elsner et al. | 83/105 X |
| 4,373,713 | 2/1983 | Loebach | 271/303 |
| 4,534,552 | 8/1985 | Rahe | 271/279 |
| 4,572,043 | 2/1986 | Bianco | 83/18 |
| 4,592,259 | 6/1986 | Görner et al. | 83/13 |
| 4,608,115 | 8/1986 | Schroth et al. | 83/154 X |
| 4,637,286 | 1/1987 | Boggs | 83/175 |
| 4,640,164 | 2/1987 | Pavlov | 83/304 |
| 4,729,282 | 3/1988 | Kasdorf | 83/26 |

*Primary Examiner*—William L. Sikes
*Assistant Examiner*—Frank González
*Attorney, Agent, or Firm*—Nils H. Ljungman

[57] ABSTRACT

Apparatus for cutting and dividing a continuous stream of printed products, in which the paper sheet is folded by means of a longitudinal folding system and is then sheared to the format length, and in which the continuous stream of printed products is divided into two transport paths.

20 Claims, 3 Drawing Sheets

APPARATUS FOR CUTTING AND DIVIDING A CONTINUOUS STREAM OF PRINTED PRODUCTS

BACKGROUND OF THE INVENTION

1. Field of the Invention

The invention relates to printing press accessories and more particularly to apparatus for cutting and dividing a continuous stream of printed products which are transported over a longitudinal folding system for a printed paper sheet and a subsequent pair of cutting cylinders to shear the paper sheet to the format length and then divide the cut sheets into two separate paper paths.

2. Description of the Prior Art

An apparatus of the prior art for cutting and dividing a continuous sheet stream, U.S. Pat. No. 4,373,713, entitled "Diverter Mechanism", uses its own cutting cylinder pair to cut the printed paper sheet into individual products. Then there is a complex system of conveyor belts, exhibiting a roll pair with cams, which divide the incoming printed products by means of a blade so that the printed products alternately take one of two transport routes. A great deal of space is necessary for the utilization of this system. Further, its complex technical design results in high costs.

Another method of the prior art for dividing the product stream, U.S. Pat. No. 4,534,552, entitled "Sheet Diverting System", requires, in addition to the cutting cylinder pair, an additional cylinder pair in which there are controlled gripping devices to alternately divert the individual printed products to one side or the other, from where they are delivered via other belt lines and fan or spider wheels. This method, too, is very complex and expensive, particularly as a result of the two gripper cylinders which are necessary to divide the product stream. Each of the above-mentioned patents are incorporated by reference as if the entire contents thereof were fully set forth herein.

OBJECTS OF THE INVENTION

One object of the present invention is to provide an apparatus which is simply and economically able to cut and divide a continuous stream of printed products.

Another object of the present invention is to provide an apparatus which assures trouble-free operation even at high speed.

Yet another object of the present invention is to provide an apparatus in which cutting and dividing operations are performed substantially simultaneously.

A further object of the present invention is to provide an apparatus in which the cutting and dividing devices are incorporated in the cutting drums or cylinders.

SUMMARY OF THE INVENTION

The invention achieves these objects in that both cutting cylinders exhibit cutting blades alternating with rubber strips in the respective opposite cylinder so that, viewed in the direction of rotation of the cylinders, behind the rubber strips, there are diverter means for the leading edge of the product. The diverter means are mounted so that they can rotate in the cylinder body and are driven against the direction of rotation of the cutting cylinder, so that the leading edge of the following product is diverted into another transport path. In this method, therefore, only a single pair of cutting cylinders is necessary, by means of which the division is done directly, so that the individual transport routes can be kept simple and short to transport the folded finished product to the fan or spider wheels.

One embodiment of the invention resides broadly in an apparatus for cutting and dividing a continuous stream of printed product. The apparatus comprises a first rotatable cylinder and a second rotatable cylinder, each having a device for cutting the continuous stream of printed product into a given length, each cylinder being disposed to draw the continuous stream of printed product therebetween in use. Both of the cylinders have at least one cutting blade and at least one rubber strip disposed in each of the cylinders and an apparatus for aligning each cutting blade of each of the cylinders with a corresponding rubber strip of the other of the cylinders during rotation of the cylinders for cutting the printed product. A diverter arrangement is disposed in each cylinder for directing leading edges of printed product being cut. The diverter arrangement in the first cylinder is disposed to direct leading edges of a first cut portion of the printed product in a first printed product path. The diverter arrangement in the second cylinder is disposed to direct leading edges of a second cut portion of the printed product in a second printed product path.

Another embodiment of the invention resides broadly in an apparatus for cutting and dividing a continuous stream of printed product. The apparatus comprises a first rotatable cylinder and a second rotatable cylinder, each having a device for cutting the continuous stream of printed product into a given length and each cylinder being disposed with respect to the other to move the continuous stream of printed product therebetween in use. The apparatus also comprises a diverter arrangement which is disposed in each cylinder for directing leading edges of printed product being cut by the cutting apparatus and an apparatus for driving the diverter arrangement in each cylinder opposite the direction of rotatability in use of the cylinder in which each diverter arrangement is disposed. The diverter arrangement in the first cylinder is disposed to direct leading edges of a first cut portion of the printed product into a first printed product path. The diverter arrangement in the second cylinder is disposed to direct leading edges of a second cut portion of the printed product into a second printed product path.

Yet another embodiment of the invention resides broadly in an apparatus for cutting and dividing a continuous stream of printed product. The apparatus comprises a first rotatable cylinder and a second rotatable cylinder, each having a device for cutting the continuous stream of printed product into a given length, both cylinders being disposed to draw the continuous stream of printed product therebetween in use. Both cylinders have at least one cutting blade and at least one rubber strip disposed in each of the cylinders. Each cutting blade of each of the cylinders is aligned for cutting the printed product with a corresponding rubber strip of the other of the cylinders during rotation in use of both of the cylinders. The apparatus also comprises a diverter arrangement which is disposed in each cylinder for directing leading edges of cut printed product and an apparatus for driving the diverter arrangement in each cylinder opposite the direction of rotatability in use of the cylinder in which each diverter arrangement is disposed. The diverter arrangement in the first cylinder is disposed to direct leading edges of a first cut portion of the printed product in a first printed product path. The diverter arrangement in the second cylinder is disposed to direct leading edges of a second cut portion of the printed product in a second printed product path.

An aspect of the invention resides broadly in an apparatus for cutting and dividing a continuous stream of printed product wherein each cylinder has at least two cutting blades disposed on the circumference thereof.

Another aspect of the invention resides broadly in an apparatus for cutting and dividing a continuous stream of printed product wherein the cutting blades comprise a plurality of sets of two cutting blades, and further including a corresponding plurality of sets of two rubber strips.

Yet another aspect of the invention resides broadly in an apparatus for cutting and dividing a continuous stream of printed product wherein each diverter arrangement comprises a cam.

A yet further aspect of the invention resides broadly in an apparatus for cutting and dividing a continuous stream of printed product, including a cam driving arrangement for driving each cam at twice the speed of rotation of its corresponding cylinder.

Another yet further aspect of the invention resides broadly in an apparatus for cutting and dividing a continuous stream of printed product wherein the cam driving arrangement comprises spur gears.

Yet another further aspect of the invention resides broadly in an apparatus for cutting and dividing a continuous stream of printed product, including a cam driving arrangement for driving extreme ends of the cams at a circumferential velocity which is no greater than one-half the circumferential velocity of its corresponding cylinder.

Again yet another aspect of the invention resides broadly in an apparatus for cutting and dividing a continuous stream of printed product wherein the first and second printed product paths comprise a divider blade for separating the first and second cut portions, and further the first path comprises a first belt line and the second path comprises a second belt line.

Yet again another further aspect of the invention resides broadly in an apparatus for cutting and dividing a continuous stream of printed product wherein the cams have outer flanks which comprise diverter surfaces, the outer flanks being shaped and disposed to substantially align with the cylindrical outer surface of its corresponding rotatable cylinder at least during a portion of the time when each cam makes contact with the printed product.

A still further aspect of the invention resides broadly in an apparatus for cutting and dividing a continuous stream of printed product wherein each diverter arrangement is disposed adjacent to its corresponding rubber strip for making contact with the printed product substantially immediately subsequent to the printed product making contact with the adjacent corresponding adjacent rubber strip.

DESCRIPTION OF THE PREFERRED EMBODIMENTS

Figure 1:
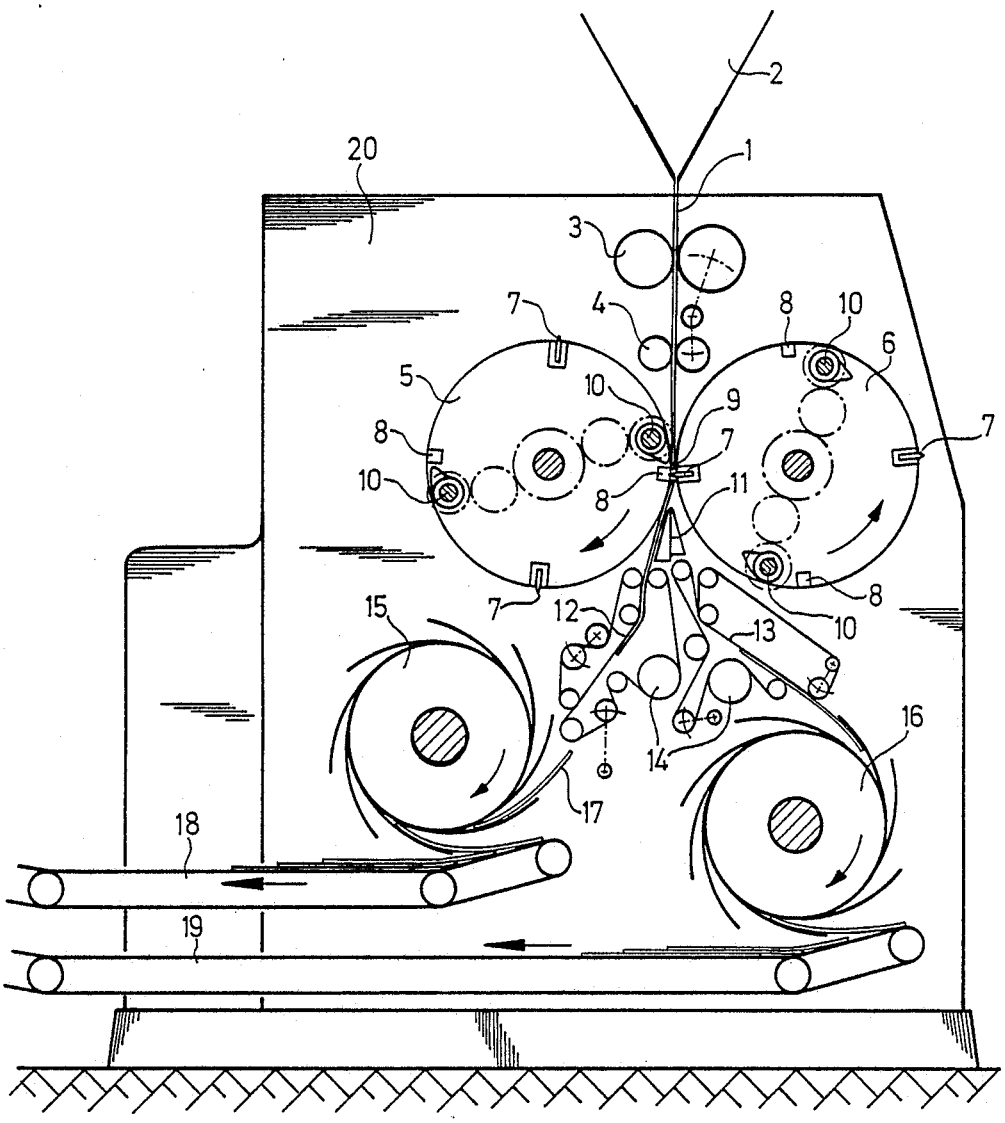
FIG. 1 shows a lateral view of the apparatus according to an embodiment of the invention.

In the apparatus illustrated in FIG. 1 for cutting and dividing a continuous stream of printed products, a paper sheet 1 is transported via a longitudinal folding system preferably in the form of a funnel 2 or with a similar shape, is folded longitudinally, and is transported via drawing rollers 3 and 4 to a pair of rotating cutting cylinders 5 and 6. Preferably, gears are provided, but not shown, which rotate cutting cylinder 5 clockwise and cutting cylinder 6 counter-clockwise both at the same speed. Each of the two cutting cylinders 5 and 6 in this embodiment is equipped with two cutting blades 7, whose corresponding rubber strips 8 are located in the opposite cylinder. The cutting blades 7 are thereby arranged so that they are offset by 90° alternately on the cutting cylinders 5 and 6 and are driven and synchronized by the gears connected between the cutting cylinders 5 and 6. The cutting blade 7 in FIG. 1, which is located on the cutting cylinder 6, is shown in the cutting position. After a one-quarter rotation of the cylinder, one format length is cut off by the cutting blade 7 on the cutting cylinder 5, so that the cutting blades 7 of the two cutting cylinders 5 and 6 always alternate with one another in use.

The printed products, when cut off, are diverted at their leading edge 9 via diverter means 10, so that they are conducted into separate transport paths. For this purpose, there is a divider blade 11 below which there are two belt lines 12 and 13. The two belt lines 12 and 13 comprise an inner and outer belt and are driven by rollers 14 which have appropriate drive mechanisms (not shown). By means of the belt lines 12 and 13, the printed products are transported alternately to fan or spider wheels 15 and 16 by means of which the printed products 17 are then deposited on delivery belts 18 and 19. All the rollers, cylinders and fan or spider wheels described above are mounted in side frames 20. All the rollers, fan or spider wheels, etc., are driven by appropriate drive mechanisms (not shown).

Figure 2:
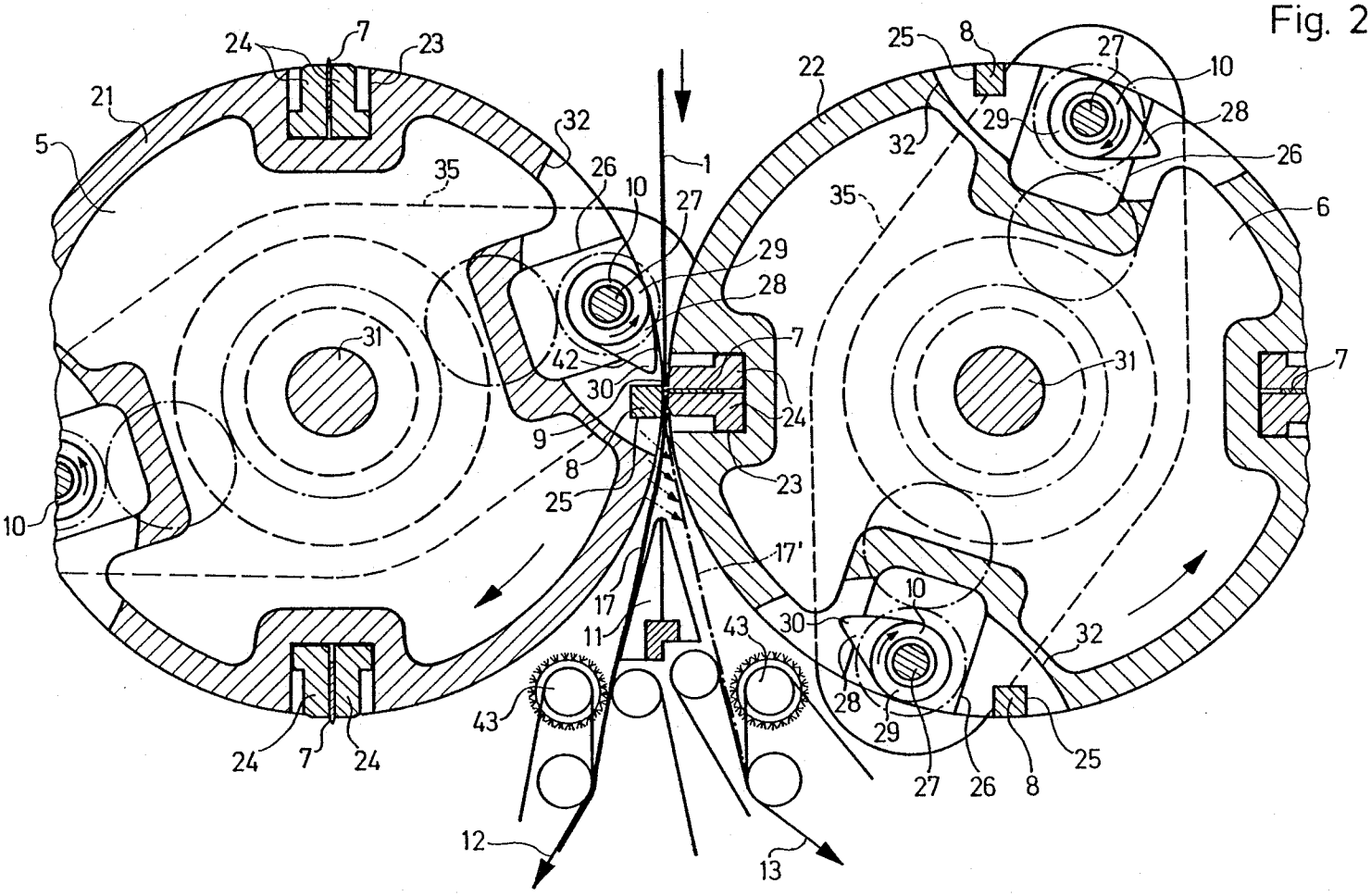
FIG. 2 shows a cross section through the cutting cylinders of FIG. 1.

FIG. 2 shows the two cutting cylinders 5 and 6 in cross section. In the cylinder bodies 21 and 22, there are grooves 23 to hold the clamping rails 24 for the cutting blade 7. Offset from them by 90° are the grooves 25 to hold the rubber strips 8.

In other longitudinal grooves 26 there are diverter means 10, which comprise a shaft 27 and cams 28 fastened to it. The cams 28 are fastened to the shaft 27 by means of clamp bushings 29. The circumferential velocity of the end of the cam 30 is preferably equal to or less than one-half of the circumferential velocity of the cylinder, whereby the direction of rotation of the shaft 27 and thus of the cams 28 is always opposite to the direction of rotation of the cutting cylinders 5 and 6. Appropriate gearing described with relation to FIG. 3, infra, provides the desired circumferential velocity of the cams 28 with respect to the circumferential velocity of the cylinders 5 and 6. The cams 28 thereby direct the leading edges 9 of the sheet into the appropriate paper paths. The cam 28 in the left cylinder 5 forces the leading edge 9 of the sheet 1 to the right, as shown by the arrows, between the cylinders 5 and 6 to the right hand path shown by a printed product 17'.

Figure 3:
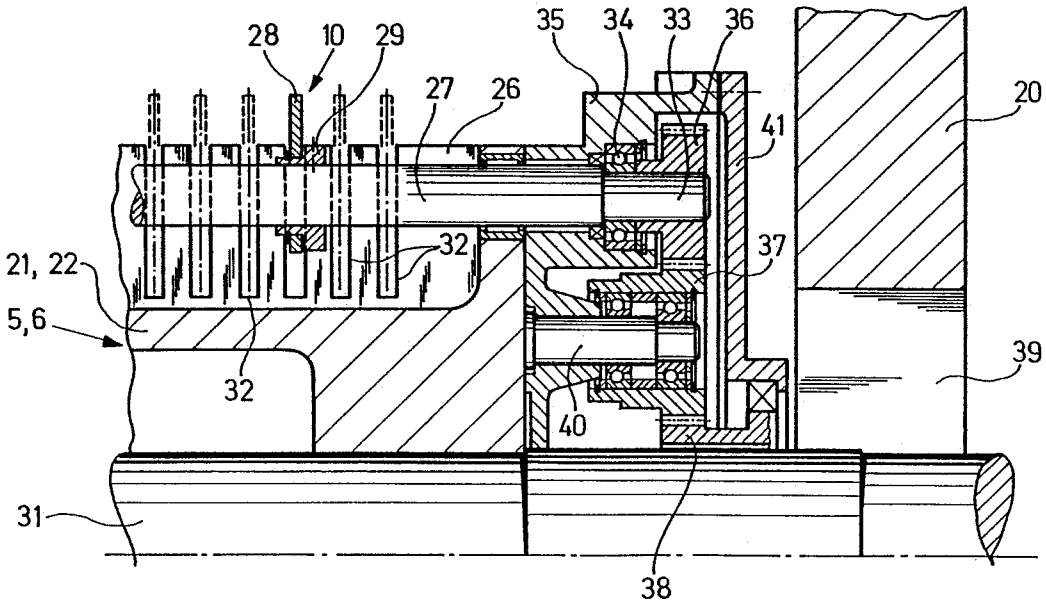
FIG. 3 soows a longitudinal section through a cutting cylinder of FIG. 2 with a diverter arrangement and its drive in the cutting cylinder.

The cross section in FIG. 3 shows the cylinder body 21 and 22 which is fastened to the cylinder shaft 31. In the longitudinal groove 26 there is a shaft 27 on which the cams 28 are mounted. The latter in turn rotate in slits 32 in the cylinder body 21 and 22. On the shaft spindle 33 there is preferably a ball bearing 34, by means of which the shaft 27 is mounted in a bearing body 35, whereby the latter is fastened to the end of the cylinder body 21 and 22. Also fastened to the shaft spindle 33 is a gear which is preferably a spur wheel 36, which is driven by means of an intermediate gear wheel 37, which intermediate wheel 37 is driven by a central gear wheel 38. The central gear wheel 38 is fastened to the bearing (not shown) of the cutting cylinder 5 and 6, which is located in the bearing hole 39. The intermediate gear wheel 37 is mounted by means of a journal 40, also in the bearing body 35. A cover 41 creates an oil-tight seal for the bearing body 35.

On account of the rotation of the cutting cylinders 5 and 6, the cams 28 are driven by means of the spur gear wheels 36, 37, and 38, whereby the drive is introduced via the stationary central gear weeel 38. As a result of the above-mentioned counterclockwise rotation of the cams 28, the leading edge 9 of the product, as shown in FIG. 2, can be diverted to the right by the tips 30 of the cams (see arrows), so that it is transported to the right of the divider blade 11 into the belt line 13. For this purpose, the diverter surface 42 on the cams 28 is fitted to the cylinder jacket of the corresponding cutting cylinder 5 and 6. Brushing rollers 43 thereby assist in transporting the sheet to the corresponding belt lines 12 and 13. In the position indicated in FIG. 2, therefore, the printed product 17 is transported over the belt line 12, while the next printed product 17' behind the cutting blade 7 is shown in dotted lines to the right in the belt line 13.

The invention as described hereinabove in the context of the preferred embodiments is not to be taken as limited to all of the provided details thereof, since modifications and variations thereof may be made without departing from the spirit and scope of the invention.

What is claimed is:

1. An apparatus for cutting and dividing a continuous stream of printed product, said apparatus comprising:

a first rotatable cylinder and a second rotatable cylinder, each having means for cutting said continuous stream of printed product into a given length, and each cylinder being disposed to draw said continuous stream of printed product therebetween in use, both said cylinders having at least one cutting blade and at least one rubber strip disposed in each of said cylinders;

means for aligning each cutting blade of each of said cylinders with a corresponding rubber strip of the other of said cylinders during rotation of said cylinders for cutting said printed product;

diverter means disposed in each said cylinder for directing leading edges of printed product being cut;

said diverter means in said first cylinder being disposed to direct leading edges of a first cut portion of said printed product in a first printed product path; and said diverter means in said second cylinder being disposed to direct leading edges of a second cut portion of said printed product in a second printed product path.

2. An apparatus for cutting and dividing a continuous stream of printed product, said apparatus comprising:

a first rotatable cylinder and a second rotatable cylinder, each having means for cutting said continuous stream of printed product into a given length, and each cylinder being disposed to draw said continuous stream of printed product therebetween in use, both said cylinders each having at least two cutting blades disposed on the circumference thereof and both said cylinders having at least one rubber strip disposed in each of said cylinders;

means for aligning each cutting blade of each of said cylinders with a corresponding rubber strip of the other of said cylinders during rotation of said cylinders for cutting said printed product;

diverter means disposed in each said cylinder for directing leading edges of printed product being cut;

said diverter means in said first cylinder being disposed to direct leading edges of a first cut portion of said printed product in a first printed product path; and said diverter means in said second cylinder being disposed to direct leading edges of a second cut portion of said printed product in a second printed product path.

3. The apparatus according to claim 2 wherein said cutting blades comprise a plurality of sets of two cutting blades, and further including a corresponding plurality of sets of two rubber strips.

4. An apparatus for cutting and dividing a continuous stream of printed product, said apparatus comprising:

a first rotatable cylinder and a second rotatable cylinder, each having means for cutting said continuous stream of printed product into a given length and each cylinder being disposed with respect to the other to move said continuous stream of printed product therebetween in use;

diverter means disposed in each said cylinder for directing leading edges of printed product being cut by said cutting means;

means for driving said diverter means in each cylinder opposite the direction of rotatability in use of the cylinder in which each said diverter means is disposed;

said diverter means in said first cylinder being disposed to direct leading edges of a first cut portion of said printed product into a first printed product path; and said diverter means in said second cylinder being disposed to direct leading edges of a second cut portion of said printed product into a second printed product path.

5. The apparatus according to claim 4 wherein each said diverter means comprise a cam.

6. The apparatus according to claim 5 including cam driving means for driving each said cam at twice the speed of rotation of its corresponding cylinder.

7. The apparatus according to claim 6 wherein said cam driving means comprises spur gears.

8. The apparatus according to claim 6 including cam driving means for driving extreme ends of said cams at a circumferential velocity which is no greater than one-half the circumferential velocity of its corresponding cylinder.

9. The apparatus according to claim 4 wherein said first and second printed product paths comprise a divider blade for separating said first and second cut portions and further comprising first and second belt lines.

10. The apparatus according to claim 4 wherein said cams have outer flanks which comprise diverter surfaces, said outer flanks being shaped and disposed to substantially align with the cylindrical surface of its corresponding rotatable cylinder when each said cam makes contact with said printed product.

11. An apparatus for cutting and dividing a continuous stream of printed product, said apparatus comprising:

a first rotatable cylinder and a second rotatable cylinder, each having means for cutting said continuous stream of printed product into a given length and both cylinders being disposed to draw said continuous stream of printed product therebetween in use, both said cylinders having at least one cutting blade and at least one rubber strip disposed in each of said cylinders, each cutting blade of each of said cylinders being aligned for cutting said printed product with a corresponding rubber strip of the other of said cylinders during rotation in use of both of said cylinders;

diverter means disposed in each said cylinder for directing leading edges of cut printed product;

means for driving said diverter means in each cylinder opposite the direction of rotatability in use of the cylinder in which each said diverter means is disposed;

said diverter means in said first cylinder being disposed to direct leading edges of a first cut portion of said printed product in a first printed product path; and said diverter means in said second cylinder being disposed to direct leading edges of a second cut portion of said printed product in a second printed product path.

12. The apparatus according to claim 11 wherein each cylinder has at least two cutting blades disposed on the circumference thereof.

13. The apparatus according to claim 12 wherein said cutting blades comprise a plurality of sets of two cutting blades, and further including a corresponding plurality of sets of two rubber strips.

14. The apparatus according to claim 11 wherein each said diverter means comprise a cam.

15. The apparatus according to claim 14 including cam driving means for driving each said cam at twice the speed of rotation of its corresponding cylinder.

16. The apparatus according to claim 15 wherein said cam driving means comprises spur gears.

17. The apparatus according to claim 14 including cam driving means for driving extreme ends of said cams at a circumferential velocity which is no greater than one-half the circumferential velocity of its corresponding cylinder.

18. The apparatus according to claim 11 wherein said first and second printed product paths comprise a divider blade for separating said first and second cut portions, and further said first path comprising a first belt line and said second path comprising a second belt line.

19. The apparatus according to claim 14 wherein said cams have outer flanks which comprise diverter surfaces, said outer flanks being shaped and disposed to substantially align with the cylindrical outer surface of its corresponding rotatable cylinder at least during a portion of the time when each said cam makes contact with said printed product.

20. The apparatus according to claim 11 wherein each said diverter means is disposed adjacent to its corresponding rubber strip for making contact with the printed product substantially immediately subsequent to the printed product making contact with said adjacent corresponding adjacent rubber strip.

* * * * *